US012624628B2

(12) United States Patent
Segura Dominguez et al.

(10) Patent No.: US 12,624,628 B2
(45) Date of Patent: May 12, 2026

(54) SYSTEMS AND METHODS FOR AUTOMATED COILED TUBING DRILLING OPERATIONS

(71) Applicant: Schlumberger Technology Corporation, Sugar Land, TX (US)

(72) Inventors: Jordi Segura Dominguez, Tananger (NO); Andrei Casali, Tananger (NO); Azwan Hadi Keong, Tananger (NO); Pierre Ramondenc, Clamart (FR); Shunfeng Zheng, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/749,914

(22) Filed: Jun. 21, 2024

(65) Prior Publication Data

US 2024/0426204 A1 Dec. 26, 2024

Related U.S. Application Data

(60) Provisional application No. 63/509,798, filed on Jun. 23, 2023.

(51) Int. Cl.

| | |
|---|---|
| ***E21B 44/00*** | (2006.01) |
| ***E21B 7/06*** | (2006.01) |
| ***E21B 19/22*** | (2006.01) |
| ***E21B 21/08*** | (2006.01) |

(52) U.S. Cl.

CPC ..... *E21B 44/00* (2013.01); *E21B 7/068* (2013.01); *E21B 21/08* (2013.01); *E21B 19/22* (2013.01)

(58) Field of Classification Search

CPC ..... E21B 44/00; E21B 7/068; E21B 21/08; E21B 19/22

See application file for complete search history.

(56) References Cited

U.S. PATENT DOCUMENTS

| | | | |
|---|---|---|---|
| 2,919,709 | A | 1/1960 | Schwegman |
| 3,040,710 | A | 6/1962 | Wilder |
| 3,954,138 | A | 5/1976 | Miffre |
| 4,615,399 | A | 10/1986 | Schoeffler |
| 6,854,953 | B2 | 2/2005 | Van Drentham-Susman |

(Continued)

FOREIGN PATENT DOCUMENTS

| | | | |
|---|---|---|---|
| GB | 2315508 | A | 2/1998 |
| WO | 2012170273 | A1 | 12/2012 |

(Continued)

OTHER PUBLICATIONS

SLB, CTDirect Coiled Tubing Directional Drilling System product brochure, 2019, 12 pages.

*Primary Examiner* — Brad Harcourt
(74) *Attorney, Agent, or Firm* — Jeffrey D. Frantz

(57) ABSTRACT

Systems and methods presented herein facilitate automation of coiled tubing drilling (CTD) operations. For example, a computer-implemented method includes performing a drilling operation via a CTD system; detecting data relating to one or more operating parameters of the drilling operation via one or more sensors of the CTD system during the drilling operation; and automatically adjusting at least one adjustable operating parameter of the drilling operation based on the detected data during the drilling operation.

15 Claims, 5 Drawing Sheets

(56) References Cited

U.S. PATENT DOCUMENTS

| | | | | |
|---|---|---|---|---|
| 8,069,926 | B2 | 12/2011 | Eddison | |
| 8,251,155 | B2 | 8/2012 | Tunc | |
| 9,145,748 | B1 | 9/2015 | Meier | |
| 10,280,731 | B2 | 5/2019 | Aitken | |
| 10,480,275 | B2 | 11/2019 | Vander Velde | |
| 10,907,463 | B2 | 2/2021 | Zheng | |
| 11,060,400 | B1 | 7/2021 | Jamison | |
| 11,339,622 | B2 | 5/2022 | Dubuc | |
| 11,619,124 | B2 | 4/2023 | Morrison | |
| 11,808,097 | B2 | 11/2023 | Morrison | |
| 12,000,261 | B2 | 6/2024 | Liu | |
| 12,055,027 | B2 | 8/2024 | Zheng | |
| 12,152,481 | B2 * | 11/2024 | Mehta | G06Q 10/0639 |
| 2004/0065477 | A1 | 4/2004 | Paulk | |
| 2006/0225885 | A1 | 10/2006 | McGarian | |
| 2007/0151762 | A1 * | 7/2007 | Reitsma | E21B 21/08 175/45 |
| 2009/0301734 | A1 | 12/2009 | Tunc | |
| 2014/0110167 | A1 * | 4/2014 | Goebel | G06N 3/08 175/24 |
| 2014/0151127 | A1 | 6/2014 | West | |
| 2016/0024884 | A1 | 1/2016 | Baudoin | |
| 2017/0268324 | A1 * | 9/2017 | Moore | E21B 44/00 |
| 2020/0173268 | A1 | 6/2020 | Zhang, Jr. | |
| 2020/0318471 | A1 * | 10/2020 | Papouras | E21B 41/00 |
| 2020/0370379 | A1 * | 11/2020 | Morrison | E21B 47/12 |
| 2021/0140274 | A1 * | 5/2021 | Forshaw | E21B 44/00 |
| 2021/0270097 | A1 | 9/2021 | Ng | |
| 2021/0310342 | A1 | 10/2021 | Marsala | |
| 2022/0251927 | A1 * | 8/2022 | Samuel | E21B 47/00 |
| 2022/0372862 | A1 * | 11/2022 | Boone | E21B 44/02 |
| 2023/0383638 | A1 * | 11/2023 | Tayla | E21B 7/04 |
| 2023/0383646 | A1 | 11/2023 | Yip | |
| 2024/0141758 | A1 * | 5/2024 | Al-Mousa | E21B 21/08 |
| 2024/0287859 | A1 | 8/2024 | Dvorak | |
| 2024/0287860 | A1 | 8/2024 | Su | |
| 2024/0287883 | A1 | 8/2024 | Tardy | |
| 2025/0027402 | A1 | 1/2025 | Abuhaikal | |
| 2025/0084754 | A1 | 3/2025 | Hassig Fonseca | |
| 2025/0084758 | A1 | 3/2025 | Tardy | |

FOREIGN PATENT DOCUMENTS

| | | | |
|---|---|---|---|
| WO | 2022026804 | A1 | 2/2022 |
| WO | 2022271589 | A1 | 12/2022 |
| WO | 2022271591 | A1 | 12/2022 |
| WO | 2022271594 | A1 | 12/2022 |
| WO | 2023077144 | A1 | 5/2023 |
| WO | 2024035758 | A1 | 2/2024 |
| WO | 2024118706 | A1 | 6/2024 |
| WO | 2024151569 | A1 | 7/2024 |
| WO | 2024229316 | A1 | 11/2024 |
| WO | 2024264037 | A1 | 12/2024 |
| WO | 2025096987 | A1 | 5/2025 |
| WO | 2025122527 | A1 | 6/2025 |

* cited by examiner

SYSTEMS AND METHODS FOR AUTOMATED COILED TUBING DRILLING OPERATIONS

CROSS-REFERENCE TO RELATED APPLICATION

This application claims priority to and the benefit of U.S. Provisional Patent Application Ser. No. 63/509,798, entitled "Systems and Methods for Automated Coiled-Tubing Drilling Operations," filed Jun. 23, 2023, which is hereby incorporated by reference in its entirety for all purposes.

BACKGROUND

The present disclosure generally relates to systems and methods for automating coiled tubing drilling operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, a coiled tubing pipe, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include systems and methods for automating coiled tubing drilling operations. For example, a computer-implemented method may include performing a drilling operation via a coiled tubing drilling system; detecting data relating to one or more operating parameters of the drilling operation via one or more sensors of the coiled tubing drilling system during the drilling operation; and automatically adjusting at least one adjustable operating parameter of the drilling operation based on the detected data during the drilling operation.

In addition, a computer-implemented method may include performing a drilling operation via a coiled tubing drilling system; detecting data relating to one or more operating parameters of the drilling operation via one or more sensors of the coiled tubing drilling system during the drilling operation; and auto-geosteering a bottom hole assembly (BHA) of the coiled tubing drilling system to reach a target formation during the drilling operation.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
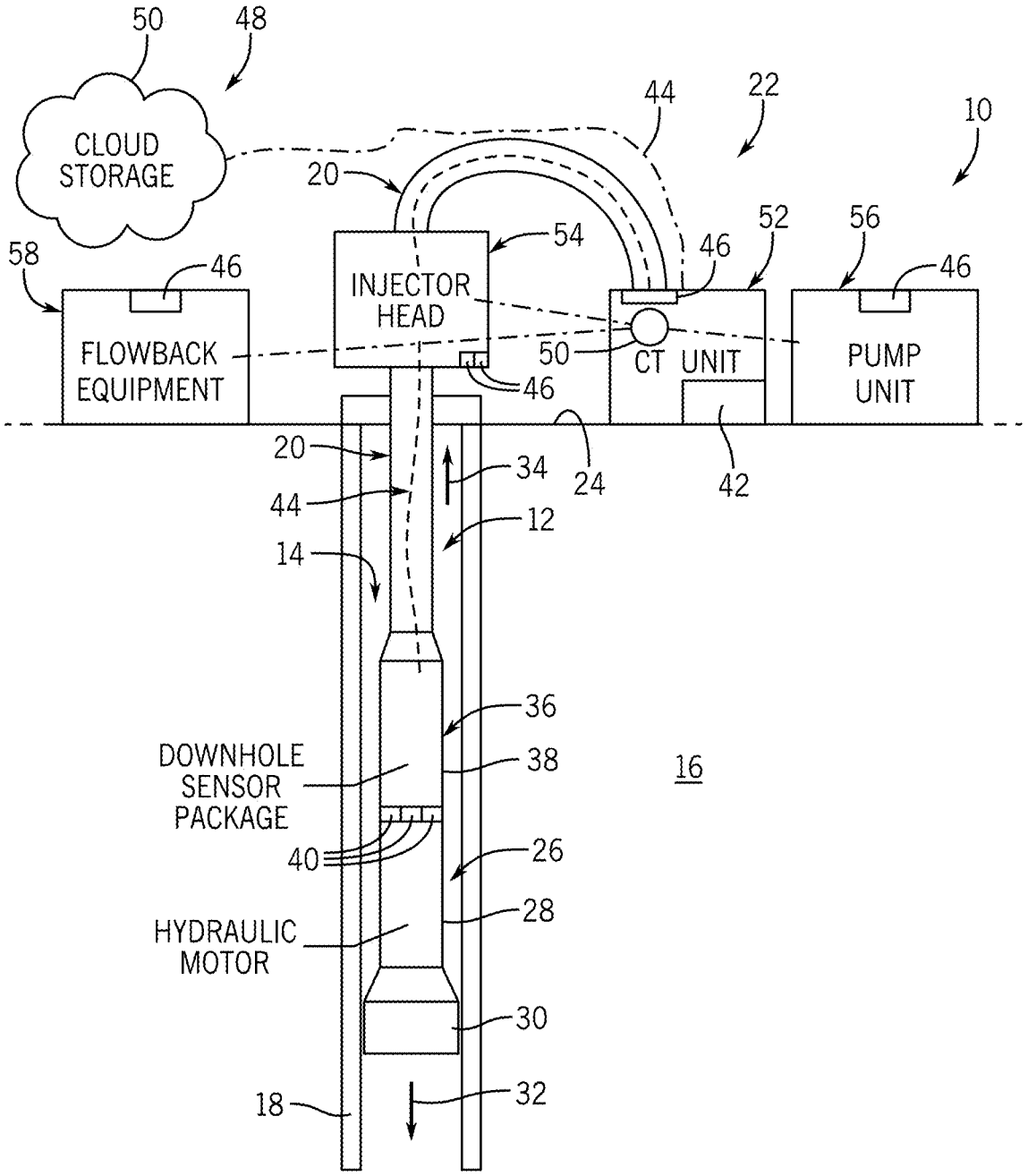
FIG. 1 illustrates a schematic diagram of an example coiled tubing drilling (CTD) system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

Coiled tubing (CT) automated conveyance includes automated execution of a particular set of instructions provided to software. Conversely, coiled tubing drilling (CTD) generally relies on an operator/driller to interpret data and react to maintain ideal operating conditions. CTD involves the use of CT surface equipment with drilling bottom hole assemblies to create new wellbores, which may include the drilling of multi-laterals in existing wells. CTD is a cost-effective way of targeting additional contact with the reservoir, particularly when compared to the use of a drilling rig. The embodiments described herein combine CT automation and CTD into adaptive automated CTD using surface and/or downhole measurements as the basis for operating parameters.

With the foregoing in mind, FIG. 1 illustrates a schematic diagram of an example CTD system 10. As illustrated, in certain embodiments, a CT string 12 may be run into a wellbore 14 that traverses a hydrocarbon-bearing formation 16 (i.e., reservoir). While certain elements of the CTD system 10 are illustrated in FIG. 1, other elements of the CTD system 10 (e.g., blow-out preventers, wellhead "tree", etc.) may be omitted for clarity of illustration. In certain embodiments, the CTD system 10 includes an interconnection of pipes, including vertical and/or horizontal casings 18, CT 20, and so forth, that connect to a surface facility 22 at the surface 24 of the CTD system 10. In certain embodiments, the CT 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the CT 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the CTD system 10. In certain embodiments, the BHA 26 may be connected to the CT 20, which is used to run the BHA 26 to a desired location within the wellbore 14. It is also contemplated that, in certain embodiments, the rotary motion of the drill bit 30 may be driven by rotation of the CT 20 effectuated by a rotary table or other surface-located rotary actuator. In such embodiments, the downhole motor 28 may be omitted.

In certain embodiments, the CT 20 may also be used to deliver fluid 32 to the drill bit 30 through an interior of the CT 20 to aid in the drilling process and carry cuttings and possibly other fluid or solid components in return fluid 34 that flows up the annulus between the CT 20 and the casing 18 (or via a return flow path provided by the CT 20, in certain embodiments) for return to the surface facility 22. It is also contemplated that the return fluid 34 may include remnant proppant (e.g., sand) or possibly rock fragments that result from a hydraulic fracturing application, and flow within the CTD system 10. Under certain conditions, fracturing fluid and possibly hydrocarbons (oil and/or gas), proppants and possibly rock fragments may flow from the fractured formation 16 through perforations in a newly opened interval and back to the surface 24 of the CTD system 10 as part of the return fluid 34. In certain embodiments, the BHA 26 may be supplemented behind the rotary drill by an isolation device such as, for example, an inflatable packer that may be activated to isolate the zone below or above it and enable local pressure tests. In addition, in certain embodiments, the BHA 26 may include a tractor system that is capable of improving reach and WOB of the BHA 26 during CTD operations.

As such, in certain embodiments, the CTD system 10 may include a downhole well tool 36 that is moved along the wellbore 14 via the CT 20. In certain embodiments, the downhole well tool 36 may include a variety of drilling/cutting tools coupled with the CT 20. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an openhole wellbore or a cased wellbore defined by the casing 18. In addition, in certain embodiments, the wellbore 14 may be vertical or horizontal or inclined. It should be noted the downhole well tool 36 may be part of various types of BHAs 26 coupled to the CT 20.

As also illustrated in FIG. 1, in certain embodiments, the CTD system 10 may include a downhole sensor package 38 having multiple downhole sensors 40. In certain embodiments, the sensor package 38 may be mounted along the CT string 12, although certain downhole sensors 40 may be positioned at other downhole locations in other embodiments. In addition, in certain embodiments, downhole sensors 40 disposed on the CT 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, downhole pressures, axial load (or "weight") and torque applied on the bit, casing collar locators (CCLs), resistivity, and so forth, in the wellbore 14.

In certain embodiments, data from the downhole sensors 40 may be relayed uphole to a surface processing system 42 (e.g., a computer-based processing system) disposed at the surface 24 and/or other suitable location of the CTD system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the CT 20, within a wall of the CT 20, or along an exterior of the CT 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the CT 20 may be deployed by a CT unit 52 and delivered downhole via an injector head 54. In certain embodiments, the injector head 54 may be controlled to slack off or pick up the CT 20 so as to control the tubing string weight and, thus, the weight-on-bit (WOB) acting on the drill bit 30 (or the downhole well tool 36). In certain embodiments, the downhole well tool 36 may be moved along the wellbore 14 via the CT 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, as described in greater detail herein, the data may be used to fully or partially automate downhole operations, to optimize the downhole operations, and/or to provide more accurate predictions regarding components or aspects of the downhole operations.

In certain embodiments, one or more pump units 56 may be provisioned for the operation. For example, in certain embodiments, one or more pump units 56 may be used to pump liquid into the CT 20. Also, additional pump units 56 may be used to pump $N_2$ into the CT 20. For the rest of the applications, without loss of generality, the term "fluid" or "fluid regime" is used herein to refer to either liquid, $N_2$, or a mixture of both liquid and $N_2$ pumped by pumping units 56 into the CT 20. In certain embodiments, fluid 32 may be delivered downhole under pressure from a pump unit 56. In certain embodiments, the fluid 32 may be delivered by the pump unit 56 through the downhole motor 28 to power the downhole motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the CT unit 52, the injector head 54, the pump unit 56, and the flowback equipment 58 may include advanced surface sensors 46, actuators, and local controllers, such as PLCs, which may cooperate together to provide sensor data to receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the CT unit 52 may be configured to detect positions of the CT 20, weights of the CT 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

Figure 2:
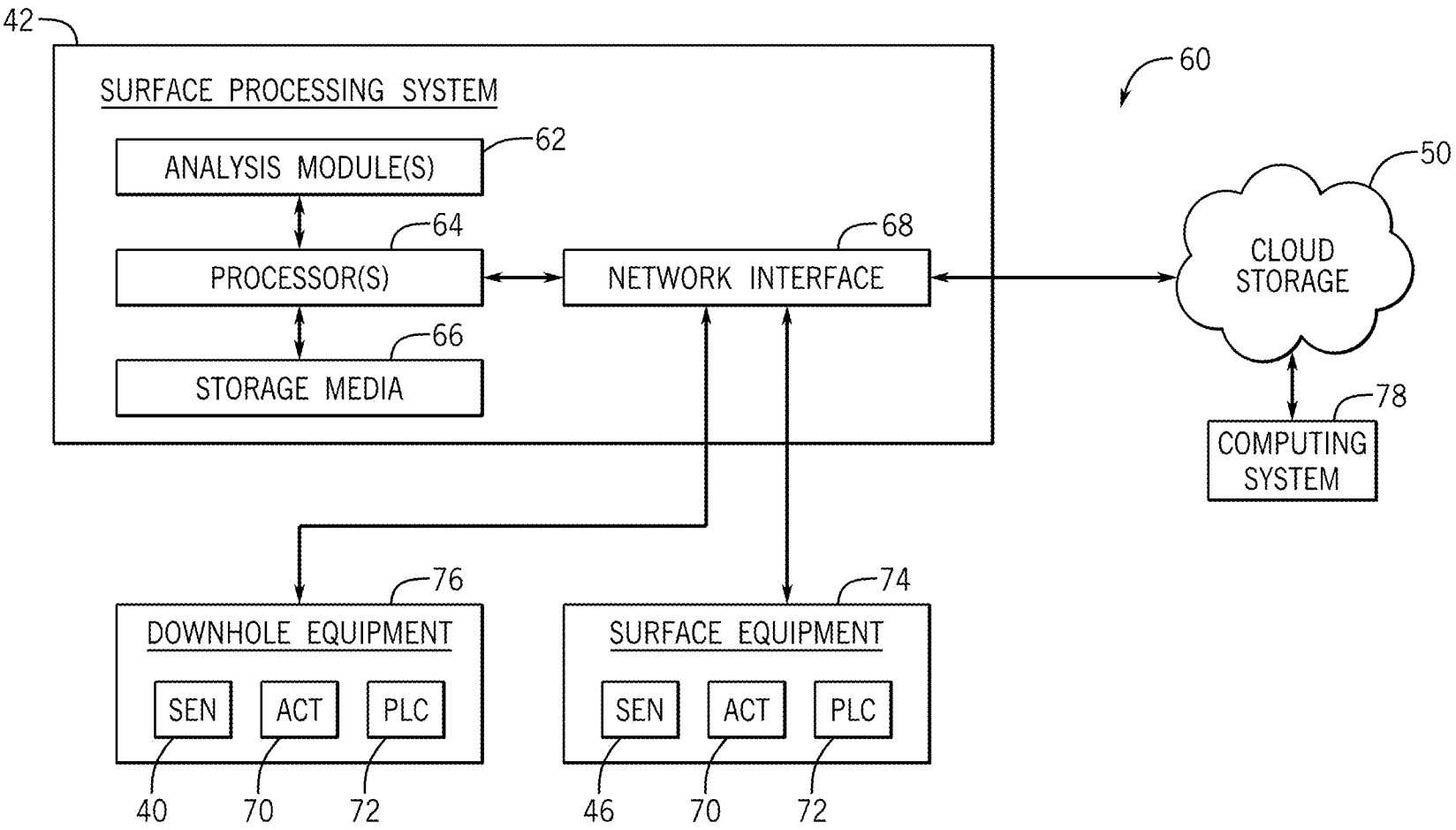
FIG. 2 illustrates a well control system including a surface processing system to control the CTD system of FIG. 1, in accordance with embodiments of the present disclosure.

FIG. 2 illustrates a well control system 60 that may include the surface processing system 42 to control the CTD system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the computer-executable instructions of the one or more analysis modules 62, when executed by the one or more processors 64, may cause the one or more processors 64 to generate one or more models (e.g., including the FM described in greater detail herein). Such models may be used by the surface processing system 42 to predict values of operational parameters that may or may not be measured (e.g., using gauges, sensors) during well operations.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or PLCs 72 of the surface equipment 74 (e.g., the CT unit 52, the injector head 54, the pump unit 56, the flowback equipment 58, and so forth) and of the downhole equipment 76 (e.g., the BHA 26, the downhole motor 28, the drill bit 30, the downhole well tool 36, and so forth) for the purpose of controlling operation of the CTD system 10, as described in greater detail herein. In certain embodiments, the network interface 68 may also facilitate the surface processing system 42 to communicate data to the cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). As described in greater detail herein, in certain embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls. In particular, as described in greater detail herein, the data may be used to facilitate automated CTD operations.

As described in greater detail herein, in certain embodiments, downhole parameters may be obtained via, for example, downhole sensors 40 while the downhole well tool 36 is disposed within the wellbore 14. In certain embodiments, the downhole parameters may be obtained in substantially real time and sent to the surface processing system 42 via wired or wireless telemetry. In certain embodiments, downhole parameters may be combined with surface parameters by the surface processing system 42. In certain embodiments, the downhole and surface parameters may be processed by the surface processing system 42 during use of the downhole well tool 36 to enable automatic (e.g., without human intervention) optimization with respect to use of the downhole well tool 36 during subsequent stages of operation of the downhole well tool 36.

Non-limiting examples of downhole parameters that may be sensed in substantially real time include, but are not limited to, weight-on-bit (WOB), torque acting on the downhole well tool 36, vibrations, downhole pressures, downhole differential pressures, spectroscopy (e.g., CCL/gamma ray/resistivity) readings, and other desired downhole parameters. In addition, as described above, in certain embodiments, the BHA 26 may include a tractor system. In such embodiments, the downhole parameters (e.g., axial load, or "tension/compression") may be used by the surface processing system 42 to better operate the tractor system and, as a consequence, optimize the reach and/or ROP and/or WOB of the CTD system 10.

In certain embodiments, downhole parameters may be used by the surface processing system 42 in combination with surface parameters, and such surface parameters may include, but are not limited to, pump-related parameters (e.g., pump rate and circulating pressures of the pump unit 56). In certain embodiments, the surface parameters also may include parameters related to fluid and solid returns (e.g., wellhead pressure, return fluid flow rate, choke settings, amount of proppant returned, and other desired surface parameters). In certain embodiments, the surface parameters also may include data from the CT unit 52 (e.g., surface weight of the CT string 12, speed of the CT 20, rate of penetration, and other desired parameters, as described in greater detail herein). In certain embodiments, the surface data that may be processed by the surface processing system 42 to facilitate automated CTD operations, as described in greater detail herein, also may include previously recorded data such as fracturing data (e.g., close-in pressures from each fracturing stage, proppant data, friction data, fluid volume data, and so forth) or wellbore and reservoir data (e.g., wellbore deviation, wellbore completion details, reservoir petrophysics information, and so forth).

In certain embodiments, use of the downhole data and surface data enables the surface processing system 42 to self-learn (e.g., modeling or simulation using the machine learning or artificial intelligence (AI) based processors, machine learning or AI based algorithms stored in the one or more storage media 66, or combinations thereof). For example, in certain embodiments, the downhole data and surface data described herein may be used to train machine learning or AI based algorithms of the surface processing system 42 to determine certain operating parameter adjustments that may be automatically implemented to improve CTD operations in substantially real time during the CTD operations. Furthermore, in certain embodiments, data relating to operation of other downhole CTD operations may be used to train the machine learning or AI based algorithms of the surface processing system 42 to determine the operating parameter adjustments that may be automatically implemented to improve the CTD operations in substantially real time during the CTD operations. This real-time modeling by the surface processing system 42, based on the downhole and surface parameters, enables improved downhole operations, particularly automated CTD operations, as described in greater detail herein. Such modeling by the surface processing system 42 also enables the downhole process to be automated and automatically optimized by the surface processing system 42. For instance, the modeling based on the downhole parameters may be used by the surface processing system 42 to predict wear on the downhole motor 28 and/or the drill bit 30, adjust the operating parameters to minimize wear on the downhole motor 28 and/or the drill bit 30, and to advise as to timing of the next trip to the surface for replacement of the downhole motor 28 and/or the drill bit 30.

In certain embodiments, the modeling based on the downhole parameters also enable use of pressures to be used by the surface processing system 42 in characterizing the formation 16. Such real-time downhole parameters also enable use of pressures by the surface processing system 42 for in situ evaluation and advisory of post-fracturing flow back parameters, and for creating an optimum flow back schedule for maximized production of, for example, hydrocarbon fluids from the surrounding formation 16. Data available from a given well may be utilized in designing the next fracturing schedule for the same pad/neighbor wells as well as predictions regarding subsequent wells.

For example, downhole data such as WOB, torque data from a load module associated with the downhole well tool 36, and bottom hole pressures (internal and external to the CT 20 and/or the BHA 26/downhole well tool 36) may be processed via the surface processing system 42. As but one non-limiting example, the processed data may then be utilized by the surface processing system 42 to control the injector head 54 to generate, for example, a faster and more controlled rate of penetration (ROP). Additionally, the processed data may be updated by the surface processing system 42 as the downhole well tool 36 is moved to different positions along the wellbore 14 to help optimize operations. The processed data also enables automation of the downhole process through automated controls over the injector head 54 and/or pump unit 56 via control instructions provided by the surface processing system 42.

In certain embodiments, data from downhole may be combined by the surface processing system 42 with surface data received from injector head 54 and/or other measured or stored surface data. By way of example, surface data may include hanging weight of the CT string 12, speed of the CT 20, wellhead pressure, choke and flow back pressures, return pump rates, circulating pressures (e.g., circulating pressures from the manifold of a CT reel in the CT unit 52), and pump rates. The surface data may be combined with the downhole data by the surface processing system 42 in real time to provide an automated system that self-controls the injector head 54, as well as other surface equipment. For example, in certain embodiments, the injector head 54 may be automatically controlled (e.g., without human intervention) to optimize ROP or motor/drill bit wear under direction from the surface processing system 42.

In addition, it should be noted that, in certain embodiments, data relating to operation of other downhole CTD operations may be received by the surface processing system 42 from the cloud storage 50, and may be used in conjunction with the downhole data and/or the surface data collected by the sensors 40, 46 described herein to determine how to automatically adjust the CTD operating parameters described herein during the CTD operations. In addition, in certain embodiments, the downhole data and/or the surface data collected by the sensors 40, 46 may be transmitted to the cloud storage 50 to enable future analysis by the surface processing system 42 (or other surface processing systems 42 associated with other well systems and/or other external computing systems 78), for example, during future CTD operations.

In certain embodiments, data from drilling parameters (e.g., surveys and pressures) as well as fracturing parameters (e.g., volumes and pressures) may be combined with real-time data obtained from the sensors 40, 46. The combined data may be used by the surface processing system 42 in a manner that aids in machine learning and/or artificial intelligence to automate subsequent jobs in the same well and/or for neighboring wells by, for example, utilizing the machine learning and/or artificial intelligence to generate future drilling plans. The accurate combination of data and the updating of that data in real time helps the surface processing system 42 improve the automatic performance of subsequent tasks, including automated CTD operations, as described in greater detail herein.

In certain embodiments, depending on the type of operation downhole, the surface processing system 42 may be programmed with a variety of algorithms and/or modeling techniques to achieve desired results. For example, the downhole data and surface data may be combined and at least some of the data may be updated in real time by the surface processing system 42. This updated data may be processed by the surface processing system 42 via suitable algorithms to enable automation of CTD operations and to improve the performance of, for example, downhole well tool 36. By way of example, the data may be processed and used by the surface processing system 42 for automating CTD operations, as described in greater detail herein. In certain embodiments, downhole parameters such as forces, torque, and pressure differentials may be combined by the surface processing system 42 to enable prediction of a next stall of the downhole motor 28 and/or to give a warning to a supervisor. In such embodiments, the surface processing system 42 may be programmed to make self-adjustments (e.g., automatically, without human intervention) to, for example, speed of the injector head 54 and/or pump pressures to prevent the stall, and to ensure efficient continuous operation. In addition, in certain embodiments, the data may be processed and used by the surface processing system 42 to automatically adjust operational parameters to minimize fluid losses to the formation 16 (e.g., in order to minimize damage to the formation 16, which would then facilitate cleanup activities and maximize later production).

In addition, in certain embodiments, the data and the ongoing collection of data may also be used by the surface processing system 42 to monitor various aspects of the performance of downhole motor 28. For example, motor wear may be detected by monitoring the effective torque of the downhole motor 28 based on data obtained regarding pump rates, pressure differentials, and actual torque measurements of the downhole well tool 36. Various algorithms may be used by the surface processing system 42 to help a supervisor on site to predict, for example, how many more hours the downhole motor 28 may be run efficiently. This data, and the appropriate processing of the data, may be used by the surface processing system 42 to make automatic decisions or to provide indications to a supervisor as to when to pull the CT string 12 to the surface to replace the downhole motor 28, the drill bit 30, or both, while avoiding unnecessary trips to the surface.

In certain embodiments, downhole data and surface data also may also be processed via the surface processing system 42 to predict a time when the CT string 12 may become stuck. The ability to predict when the CT string 12 may become stuck helps avoid unnecessary short trips and, thus, improves CT pipe longevity. In certain embodiments, downhole parameters such as forces, torque, and pressure differentials in combination with surface parameters such as weight of the CT 20, speed of the CT 20, pump rate, and circulating pressure may be processed via the surface processing system 42 to provide predictions as to the time when the CT 20 will become stuck. Based on CT stuck prediction or detection and/or past experience recorded in a storage system, a controller may be implemented to automatically execute certain operations sequences, such as changing injector speed profile, changing pump rates, etc., to mitigate the probability of the CT being stuck. Using the sensor data from both the surface sensors 46 and downhole sensors 40, similar controllers can be implemented to detect other undesirable surface and downhole events, such as bridge, CT runaway, etc. and to command relevant equipment to react automatically to prevent operation failures.

In certain embodiments, the surface processing system 42 may also be configured to provide warnings to a supervisor and/or to self-adjust (e.g., automatically, without human intervention) either the speed of the injector head 54, the pump pressures and rates of the pump unit 56, or a combination of both, so as to prevent the CT 20 from getting stuck based on the predictions described herein. By way of example, the warnings or other information may be output to a display of the surface processing system 42 to enable an operator to make better, more informed and more timely decisions regarding downhole or surface processes related to operation of the downhole well tool 36. In certain embodiments, the speed of the injector head 54 may be controlled via the surface processing system 42 by controlling the slack-off force from the surface. In general, the ability to predict and prevent the CT 20 from becoming stuck substantially improves the overall efficiency and service quality, and helps avoid unnecessary short trips if the probability of the CT 20 getting stuck is minimal. Accordingly, the downhole data and surface data may be used by the surface processing system 42 to provide advisory information and/or automation of surface processes, such as pumping processes or other processes.

Figure 3:
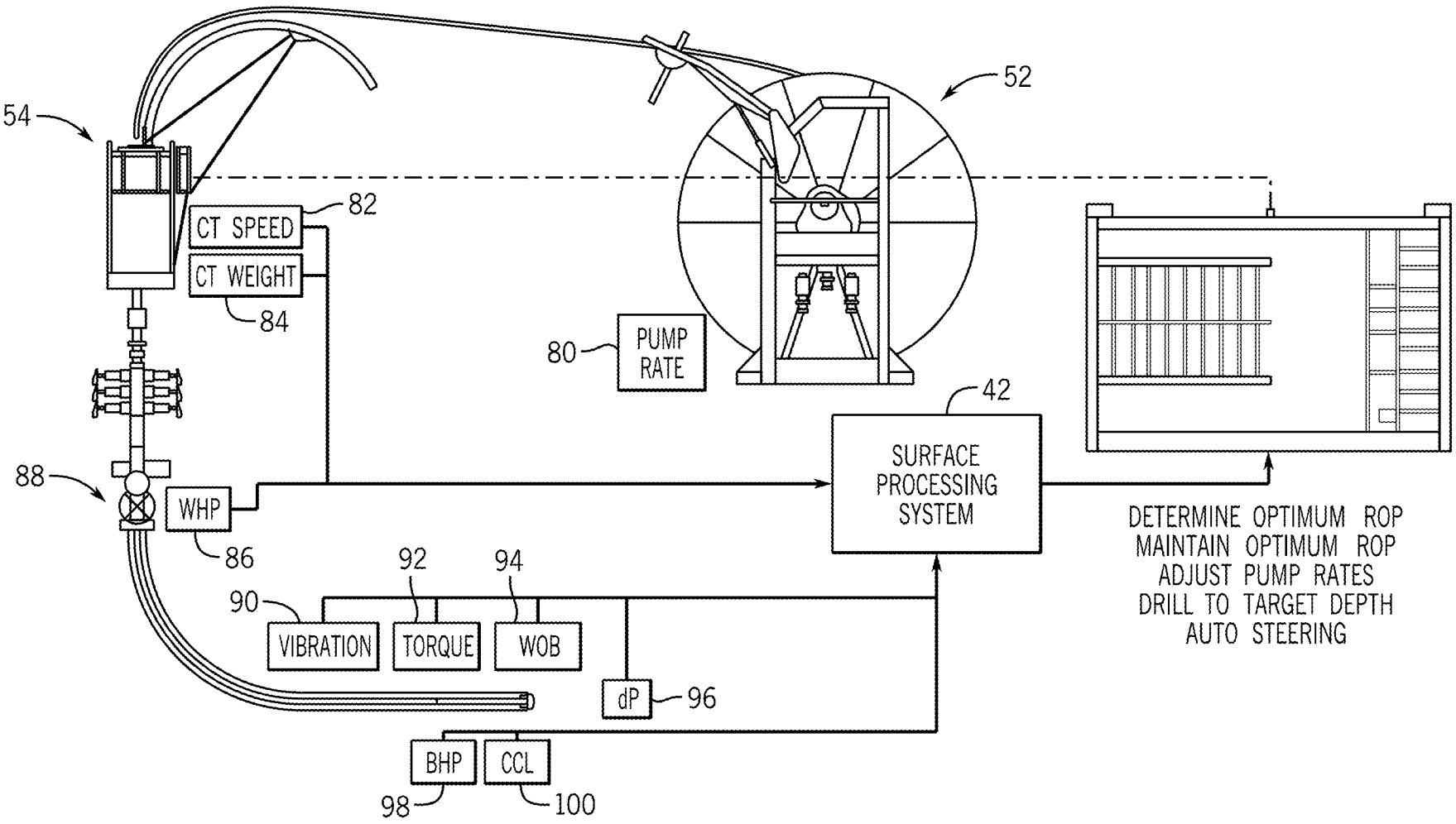
FIG. 3 is a schematic diagram of operating parameters that may be used to automate CTD operations, in accordance with embodiments of the present disclosure.

As described in greater detail herein, the surface processing system 42 may be configured to automate CTD operations in substantially real time based on the downhole data and surface data detected by the downhole and surface sensors 40, 46, respectively. As illustrated in FIG. 3, in certain embodiments, the downhole and surface parameters used by the surface processing system 42 to automate CTD operations may include, but are not limited to:

- Pump rate 80 (e.g., as measured by surface sensors 46 associated with the pump unit 56).
- Speed 82 of the CT 20 (e.g., as measured at the surface 24 by surface sensors 46 associated with the injector head 54)
- Weight 84 of the CT 20 (e.g., as measured at the surface 24 by surface sensors 46 associated with the injector head 54).
- Wellhead Pressure (WHP) 86 (e.g., as measured by surface sensors 46 associated at a wellhead 88 of the well).
- Vibrations 90 occurring in the BHA 26 (e.g., as measured by downhole sensors 40 associated with the BHA 26)
- Torque 92 acting on the BHA 26 (e.g., as measured by downhole sensors 40 associated with the BHA 26)
- Weight-on-Bit (WOB) 94 of the drill bit 30 (e.g., as measured by downhole sensors 40 associated with the BHA 26)
- Annular bottom hole pressure (BHP) 96 (e.g., as measured by downhole sensors 40 associated with the BHA 26)
- Internal BHP 98 within the CT 20 (e.g., as measured by downhole sensors 40 associated with the BHA 26)
- Spectroscopy (e.g., CCL/Gamma Ray/resistivity) readings 100 (e.g., as measured by downhole sensors 40 associated with the BHA 26)

In addition, in certain embodiments, other parameters may be considered by the surface processing system 42 to automate CTD operations to provide enhanced equipment reliability and/or sustainability aspects including, but not limited to, equipment health parameters (e.g., hydraulic power unit temperature, revolutions per minute (RPM), and so forth), equipment power consumption and/or emissions, and other equipment-related parameters.

As described in greater detail herein, the surface processing system 42 is configured to automatically adjust (e.g., without human intervention) operating parameters of CTD operations based on the downhole and surface parameters illustrated in FIG. 3, among other operating parameters detected by the downhole and surface sensors 40, 46 described herein. For example, the automatic adjustments to the operating parameters of the CTD operations may include, but are not limited to determining an optimum rate of penetration (ROP) of the drill bit 30 (e.g., a maximum possible ROP of the drill bit 30) and maintaining the optimum ROP, determining an optimum WOB 94 of the drill bit 30 (e.g., a WOB 94 that maximizes the ROP) and maintaining the optimum WOB 94, adjusting pump rates of the pump unit 56, adjusting speeds of the CT 20, adjusting pressure differentials, adjusting a toolface, adjusting a bend angle, drilling to target depths, auto-steering the BHA 26, adjusting other injector controls (e.g., tripper pressure, traction/tension, and so forth), and so forth, to minimize drilling time.

For example, based on the downhole and surface data detected by the downhole and surface sensors 40, 46 described herein, the surface processing system 42 may operate to automatically detect undesirable drilling events (such as stuck event, bridge, CT running away, and so forth) and automatically respond (e.g., without human intervention) to mitigate or avoid such undesirable events. In this manner, the drilling system may automatically respond to adverse events. Furthermore, the surface processing system 42, based on the downhole and surface data detected by the downhole and surface sensors 40, 46 described herein, may operate to automatically transmit control commands to the surface equipment 74 (e.g., the CT unit 52, the injector head 54, the pump unit 56, the flowback equipment 58, and so forth) and the downhole BHA 26 via the telemetric control line 44 (e.g., a wireline cable, a fiber-optic cable, a hybrid electro-optical cable, or any other suitable type of cable) to coordinate the control of the surface equipment 74 and the downhole BHA 26. In certain embodiments, these control commands operate to coordinate controls between the surface and downhole equipment to mitigate shock and vibration, for example, on the BHA 26. For example, in certain embodiments, the surface processing system 42 may be configured to automate the CTD operations, as described in greater detail herein, to minimize vibrations and/or instabilities incurred by the BHA 26, thereby reducing the acceleration of damage to the BHA 26.

Furthermore, in certain embodiments, the surface processing system 42, based on the downhole and surface data detected by the downhole and surface sensors 40, 46 described herein, may operate to automatically transmit control commands to different surface equipment 74 (e.g., the CT unit 52, the injector head 54, the pump unit 56, the flowback equipment 58, and so forth) to maintain the BHP within desired pressure windows. In this manner, the surface processing system 42 operates to automatically coordinate control to manage the BHP.

In addition, in certain embodiments, the surface processing system 42 may operate to automatically execute a drilling plan or a sequence of drilling instructions without human intervention. In certain embodiments, these instructions may include, for example, cruise control (e.g., to maintain certain tripping speed), automatic reduction of the tripping speed, for example, due to a restriction, or to change the tripping speed to protect a downhole motor (e.g., as a result of rubber explosive decompression). In addition, in certain embodiments, the instructions may include instruction to automatically adjust operational parameters to minimize fluid losses to the formation 16 (e.g., in order to minimize damage to the formation 16, which would then facilitate cleanup activities and maximize later production). It should be noted that, in certain embodiments, the machine learning or AI based algorithms of the surface processing system 42 described herein may generate the drilling plans or sequences of drilling instructions. In other words, instead of providing the surface processing system 42 with a drilling plan or sequence of drilling instructions, the surface processing system 42 may instead be provided with certain objectives (e.g., a well trajectory, formation information, and so forth) and the surface processing system 42 may use the machine learning or AI based algorithms to automatically generate a drilling plan or sequence of drilling instructions based on the objectives (e.g., a well trajectory, formation information, and so forth) and the other data described in greater detail herein.

Figure 4:
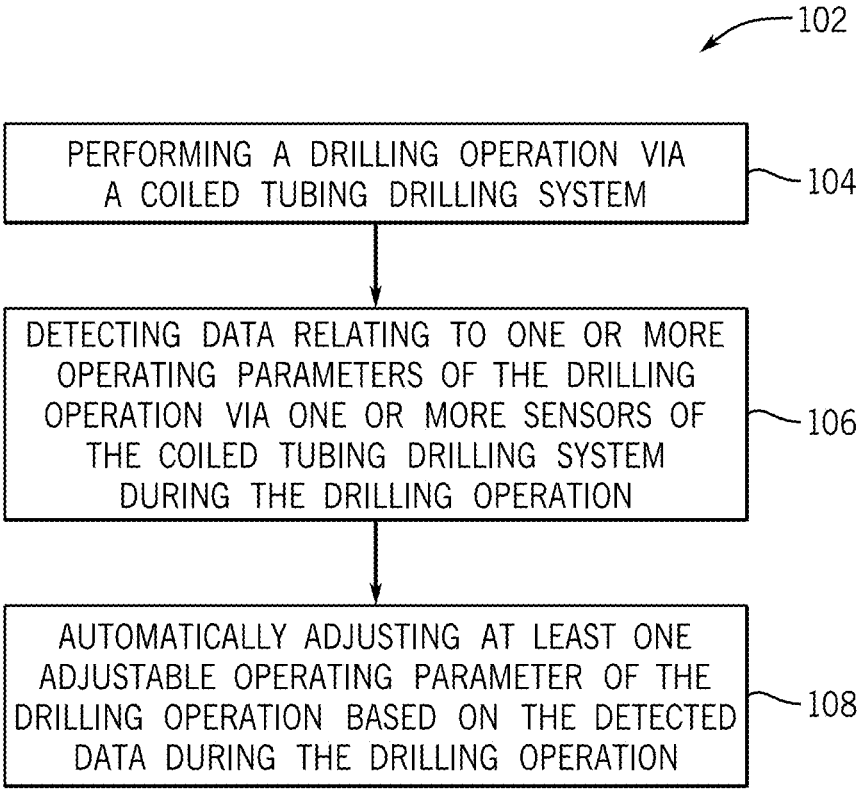
FIG. 4 is a flow diagram of a method of automating CTD operations, in accordance with embodiments of the present disclosure.

In addition, in certain embodiments, the automated CTD operations described herein may include a recovery mode, a series of steps that follows a motor stall while drilling. Entering this situation is easily detectable and, therefore, the surface processing system 42 is capable of automating such recovery. In addition, other features implemented by the surface processing system 42 may include, but are not limited to:

- System health self-diagnostics
- Equipment health parameters
- Equipment power consumption and/or emissions
- Generation of a contingency library: automated execution based on operator selection
- Automated re-run of tubing forces using new hole survey data as drilling progresses
- Lag depth calculations for cuttings analysis
- Various automated modes: For example, setting whipstock mode, setting a plug, and so forth FIG. 4 is a flow diagram of a method 102 of automating CTD operations via the surface processing system 42, as described in greater detail herein. As illustrated in FIG. 4, in certain embodiments, the method 102 may include performing a drilling operation via a CTD system 10 (step 104). In addition, in certain embodiments, the method 102 may include detecting data relating to one or more operating parameters of the drilling operation via one or more sensors 40, 46 of the CTD system 10 during the drilling operation (step 106). In addition, in certain embodiments, the method 102 may include automatically adjusting at least one adjustable operating parameter of the drilling operation based on the detected data during the drilling operation (step 108).

In certain embodiments, the method 102 may include automatically adjusting the at least one adjustable operating parameter of the drilling operation based on a drilling plan. In addition, in certain embodiments, the method 102 may include generating or adapting the drilling plan based at least in part on the detected data and one or more objectives (e.g., a well trajectory, formation information, and so forth) for the drilling operation. For example, in certain embodiments, the drilling plan may be generated or adapted by adding one or more wiper trips into the drilling plan or removing one or more wiper trips from the drilling plan. In certain embodiments, the drilling plan may be a digital drilling plan, for example, as generated by SLB's DrillOps program or other similar software packages.

In certain embodiments, automatically adjusting the at least one adjustable operating parameter may include maintaining an optimum drilling fluid regime to minimize fluid losses and damage to a formation 16, and minimizing motor stalls through which the drilling operation progresses. An optimum drilling fluid regime may consist of a combination of fluid flow rate and $N_2$ flow rate. For example, in certain embodiments, automatically adjusting the at least one adjustable operating parameter may include maintaining optimal performance of a motor or turbine (e.g., downhole motor 28) of the CTD system 10. In addition, in certain embodiments, automatically adjusting the at least one adjustable operating parameter may include minimizing a risk of a portion of the CTD system 10 becoming stuck during the drilling operation. In addition, in certain embodiments, automatically adjusting the at least one adjustable operating parameter may include minimizing vibrations and/or instabilities incurred by the BHA 26 of the CTD system 10. In addition, in certain embodiments, automatically adjusting the at least one adjustable operating parameter may include adjusting a flow rate through a drill bit 30 of the CTD system 10. For example, in certain embodiments, an automated circulating valve may be included in the BHA 26, which may enable the automatic adjustment of the flow rate through the drill bit 30 of the CTD system 10.

In addition, in certain embodiments, automatically adjusting the at least one adjustable operating parameter may include optimizing emissions of the drilling operation. In addition, in certain embodiments, automatically adjusting the at least one adjustable operating parameter may include maintaining an optimum ROP of the drill bit 30 of the CTD system 10. In addition, in certain embodiments, automatically adjusting the at least one adjustable operating parameter may include maintaining an optimum WOB of the drill bit 30 of the CTD system 10. In addition, in certain embodiments, automatically adjusting the at least one adjustable operating parameter may include adjusting a pump rate 80 of the pump unit 56 of the CTD system 10. In addition, in certain embodiments, automatically adjusting the at least one adjustable operating parameter may include adjusting a speed 82 of the CT 20 of the CTD system 10. In addition, in certain embodiments, automatically adjusting the at least one adjustable operating parameter may include adjusting a pressure differential of the CTD system 10. In addition, in certain embodiments, automatically adjusting the at least one adjustable operating parameter may include adjusting a toolface of the CTD system 10. In addition, in certain embodiments, automatically adjusting the at least one adjustable operating parameter may include adjusting a bend angle of the CTD system 10. In addition, in certain embodiments, automatically adjusting the at least one adjustable operating parameter may include drilling to a target depth. In addition, in certain embodiments, automatically adjusting the at least one adjustable operating parameter may include maintaining an optimum torque and/or WOB of a drill bit 30 of the CTD system 10. In addition, in certain embodiments, automatically adjusting the at least one adjustable operating parameter may include auto-steering the BHA 26 of the CTD system 10.

In addition, in certain embodiments, automatically adjusting the at least one adjustable operating parameter may include auto-steering the BHA 26 of the CTD system 10 to reach a target formation 16 during tripping of the BHA 26 (e.g., either before or after a drilling operation) to minimize shock and vibration to the BHA 26. In addition, in certain embodiments, automatically adjusting the at least one adjustable operating parameter may include executing a prescribed operation sequence based on a detected drilling state, such as go on bottom, go off bottom, wiper trip, sidetracking, and so forth. In addition, in certain embodiments, automatically adjusting the at least one adjustable operating parameter may include adjusting a surface drilling choke position to control the returned flow (e.g., to control the bottom hole pressure).

In certain embodiments, the detected data relates to a pump rate 80 of the pump unit 56 of the CTD system 10. In addition, in certain embodiments, the detected data relates to a speed 82 of the CT 20 of the CTD system 10. In addition, in certain embodiments, the detected data relates to a weight 84 of the CT 20 of the CTD system 10. In addition, in certain embodiments, the detected data relates to WHP 86 of a wellhead 88 of the CTD system 10. In addition, in certain embodiments, the detected data relates to vibrations 90 occurring in the BHA 26 of the CTD system 10. In addition, in certain embodiments, the detected data relates to torque 92 acting on the BHA 26 of the CTD system 10. In addition, in certain embodiments, the detected data relates to WOB 94 of the drill bit 30 of the CTD system 10. In addition, in certain embodiments, the detected data relates to an annular BHP 96. In addition, in certain embodiments, the detected data relates to an internal BHP 98 within the CT 20 of the CTD system 10. In addition, in certain embodiments, the detected data relates to petrophysics information of a formation 16 through which the drilling operation progresses. In addition, in certain embodiments, the detected data relates to a returned flow rate from the wellbore 14. In addition, in certain embodiments, the detected data relates to a returned gas flow rate from the wellbore 14. In addition, in certain embodiments, the detected data relates to resistivity information of a formation 16 through which the drilling operation progresses. In addition, in certain embodiments, the detected data relates to gamma ray information of a formation 16 through which the drilling operation progresses. In addition, in certain embodiments, the detected data relates to equipment health parameters of equipment (e.g., the surface equipment 74, the downhole equipment 76, and so forth) of the CTD system 10. In addition, in certain embodiments, the detected data relates to equipment power consumption and/or emissions of equipment (e.g., the surface equipment 74, the downhole equipment 76, and so forth) of the CTD system 10. In addition, in certain embodiments, the detected data relates to spectroscopy (e.g., CCL/Gamma Ray/resistivity) readings. It should be noted that, in addition to these types of spectroscopy readings, in other embodiments, any and all types of data relating to extracted petrophysics information from a formation 16 may be detected as a job progresses, and such data may be used to automate the CTD operations, as described in greater detail herein.

Figure 5:
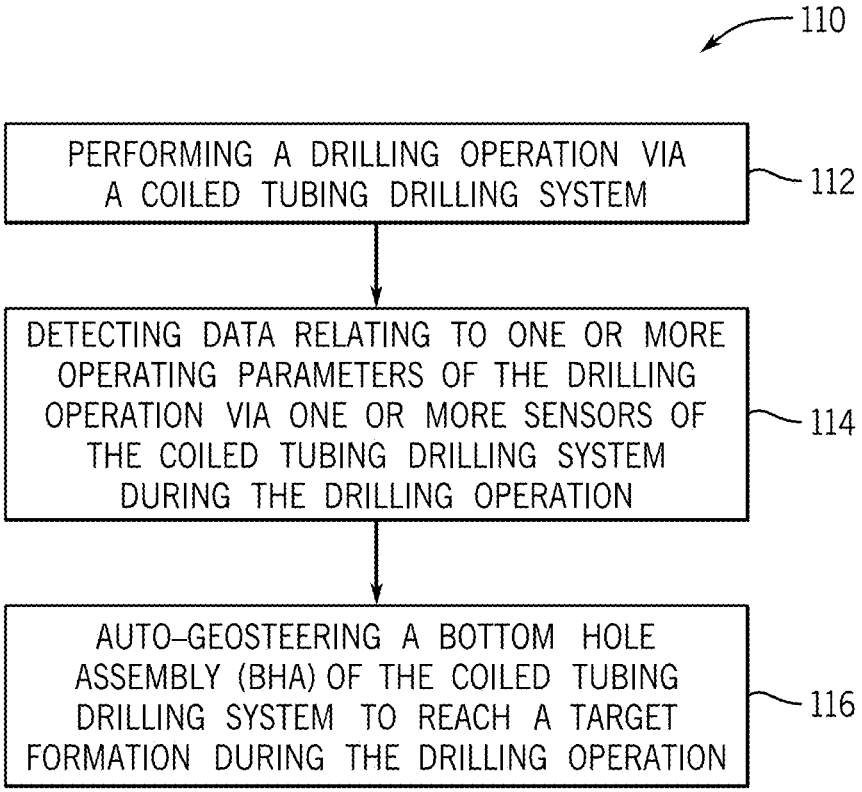
FIG. 5 is a flow diagram of another method of automating CTD operations, in accordance with embodiments of the present disclosure.

FIG. 5 is a flow diagram of another method 110 of automating CTD operations via the surface processing system 42, as described in greater detail herein. As illustrated in FIG. 5, in certain embodiments, the method 110 may include performing a drilling operation via a CTD system 10 (step 112). In addition, in certain embodiments, the method 110 may include detecting data relating to one or more operating parameters of the drilling operation via one or more sensors 40, 46 of the CTD system 10 during the drilling operation (step 114). In addition, in certain embodiments, the method 110 may include auto-geosteering the BHA 26 of the CTD system 10 to reach a target formation 16 during the drilling operation (step 116).

For example, in certain embodiments, the detected data comprises surface measurements and/or downhole measurements of formation properties, such as mud logging data, resistivity data, gamma ray data, porosity data, gas and/or oil data (and/or water detection), bed boundary detection data, or some combination thereof. In certain embodiments, the method 110 may include auto-geosteering the BHA 26 to reach a target formation 16. In addition, in certain embodiments, the method 110 may include auto-geosteering the BHA 26 to remain at a target formation 16. In addition, in certain embodiments, the method 110 may include auto-geosteering the BHA 26 to avoid a water zone (or other boundary of significance) within a target formation 16.

Certain advantages of the automated CTD operations described herein include, but are not limited to:

- Removing dependence on operator experience to determine optimum ROP
- Maximizing ROP to minimize drill time
- Enabling safe and consistent operations that lead to predictability
- Increasing awareness from operator to monitor other critical parameters
- Reducing stuck pipe time
- Reducing damage to the formation to maximize later hydrocarbon recovery The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A computer-implemented method, comprising:

performing a drilling operation via a coiled tubing drilling system;

detecting data relating to one or more operating parameters of the drilling operation via one or more sensors of the coiled tubing drilling system during the drilling operation;

predicting an event associated with the drilling operation and a time of the predicted event, wherein the event comprises a stall of a motor associated with the coiled tubing drilling system and a coiled tubing of the coiled tubing drilling system becoming stuck; and automatically adjusting at least one adjustable operating parameter of the drilling operation based on the predicted event to prevent an occurrence of the predicted event at the predicted time, wherein the at least one adjustable operating parameter comprises a speed of an injector head of the coiled tubing drilling system, a pump pressure of a pump unit of the coiled tubing drilling system, and a pump rate of the pump unit, and wherein automatically adjusting the at least one adjustable operating parameter comprises auto-steering a bottom hole assembly (BHA) of the coiled tubing drilling system to minimize shock and vibration, and stuck risk to the BHA during tripping operations.

2. The computer-implemented method of claim 1, comprising:

generating a drilling plan based at least in part on the detected data, the predicted event, and one or more objectives for the drilling operation; and automatically adjusting the at least one adjustable operating parameter of the drilling operation based on the drilling plan.

3. The computer-implemented method of claim 2, wherein the drilling plan is generated by adding one or more wiper trips into the drilling plan or removing one or more wiper trips from the drilling plan.

4. The computer-implemented method of claim 1, comprising:

adapting a drilling plan based at least in part on the detected data, the predicted event, and one or more objectives for the drilling operation; and automatically adjusting the at least one adjustable operating parameter of the drilling operation based on the drilling plan.

5. The computer-implemented method of claim 1, wherein automatically adjusting the at least one adjustable operating parameter comprises maintaining an optimum drilling fluid regime to minimize fluid losses and damage to a formation, and minimizing motor stalls through which the drilling operation progresses.

6. The computer-implemented method of claim 5, wherein automatically adjusting the at least one adjustable operating parameter comprises maintaining optimal performance of the motor or turbine of the coiled tubing drilling system.

7. The computer-implemented method of claim 1, wherein automatically adjusting the at least one adjustable operating parameter comprises minimizing a risk of the stall of the motor and the coiled tubing of the coiled tubing drilling system becoming stuck during the drilling operation, wherein the motor is a downhole motor of the BHA configured to drive rotation of a drill bit, the pump unit is configured to supply a fluid to drive rotation of the downhole motor, and the injector head is configured to feed the coiled tubing downhole during the drilling operation.

8. The computer-implemented method of claim 7, wherein automatically adjusting the at least one adjustable operating parameter comprises minimizing instabilities incurred by the BHA of the coiled tubing drilling system.

9. The computer-implemented method of claim 8, wherein automatically adjusting the at least one adjustable operating parameter comprises adjusting a flow rate through the drill bit of the coiled tubing drilling system.

10. The computer-implemented method of claim 1, wherein automatically adjusting the at least one adjustable operating parameter comprises optimizing emissions of the drilling operation.

11. The computer-implemented method of claim 1, wherein the at least one adjustable operating parameter further comprises each of:

adjusting a speed of the coiled tubing of the coiled tubing drilling system;

adjusting a pressure differential of the coiled tubing drilling system;

adjusting a toolface of the coiled tubing drilling system;

adjusting a bend angle of the coiled tubing drilling system;

drilling to a target depth of a formation; and maintaining an optimum weight-on-bit of the coiled tubing drilling system.

12. The computer-implemented method of claim 1, wherein automatically adjusting the at least one adjustable operating parameter comprises auto-steering the BHA of the coiled tubing drilling system to reach a target formation during the drilling operation.

13. The computer-implemented method of claim 1, wherein automatically adjusting the at least one adjustable operating parameter comprises executing a prescribed operation sequence based on a detected drilling state.

14. The computer-implemented method of claim 1, wherein automatically adjusting the at least one adjustable operating parameter comprises adjusting a surface drilling choke position to control a returned flow rate and to control a bottom hole pressure.

15. The computer-implemented method of claim 1, wherein the detected data relates to each of:

the pump rate of the pump unit of the coiled tubing drilling system;

a speed or weight of the coiled tubing of the coiled tubing drilling system;

a wellhead pressure of a wellhead of the coiled tubing drilling system;

a torque acting on the BHA;

a weight-on-bit (WOB) of a drill bit of the coiled tubing drilling system;

an annular bottom hole pressure;

an internal bottom hole pressure within the coiled tubing of the coiled tubing drilling system;

petrophysics information of a formation through which the drilling operation progresses;

a returned flow rate from the wellbore;

a returned gas flow rate from the wellbore;

resistivity information of the formation through which the drilling operation progresses;

gamma ray information of the formation through which the drilling operation progresses;

equipment health parameters of equipment of the coiled tubing drilling system;

equipment power consumption and/or emissions of equipment of the coiled tubing drilling system; and spectroscopy readings.

* * * * *